United States Patent [19]

Chambers et al.

[11] 4,025,841

[45] May 24, 1977

[54] CURRENT LIMITING CIRCUIT FOR VOLTAGE REGULATED POWER SUPPLY

[75] Inventors: Derek Chambers, Bedford; Robert O. Pedersen, Amherst, both of N.H.

[73] Assignee: Raytheon Company, Lexington, Mass.

[22] Filed: Nov. 10, 1975

[21] Appl. No.: 630,849

[52] U.S. Cl. ..... 323/9; 323/25; 361/18

[51] Int. Cl.² ..... G05F 1/58

[58] Field of Search ..... 323/9, 23, 25; 317/31, 317/33 VR, 22

[56] References Cited

UNITED STATES PATENTS

| | | | |
|---|---|---|---|
| 3,078,410 | 2/1963 | Thomas | 323/9 |
| 3,521,150 | 7/1970 | Bates | 323/9 |
| 3,919,601 | 11/1975 | Suko et al. | 317/31 |

FOREIGN PATENTS OR APPLICATIONS

| | | | |
|---|---|---|---|
| 243,048 | 9/1969 | U.S.S.R. | 323/9 |

*Primary Examiner*—Gerald Goldberg
*Attorney, Agent, or Firm*—Herbert W. Arnold; Joseph D. Pannone; Milton D. Bartlett

[57] ABSTRACT

A voltage subtracting diode which is utilized in the current limiting or current foldback section of the voltage regulator circuit of a power supply to offset the base-emitter voltage drop of a transistor in said regulating circuit and also to provide tracking of the base-emitter voltage of said transistor with temperature in order to stabilize the value of current limit operation and to permit accurate current limiting with a smaller value of resistance in the series pass current sensing resistor. The use of individual diodes for each pass transistor permits parallel stages of series pass transistors to be used without exceeding permitted limits in the event of a failure of one of the series pass transistors.

17 Claims, 2 Drawing Figures

CURRENT LIMITING CIRCUIT FOR VOLTAGE REGULATED POWER SUPPLY

BACKGROUND OF THE INVENTION

This invention relates generally to voltage regulated power supplies, and more particularly to improved circuit means for current limiting and for reducing the power dissipated in the current sensing resistor in a voltage regulated power supply.

Current limiting power supplies utilizing a simple current sensing resistor have the disadvantage that the power dissipated in the current limiting or sense resistor reduces the efficiency of the power supply and usually requires one or more high wattage resistors which can generate considerable heat. When simple attempts are made to reduce this dissipation by effectively adding the base-emitter drop of the series pass transistor to the drop in the sensing resistor, the temperature coefficient of the base-emitter drop in this power stage causes a change in the current limit setting as the power supply warms up. This can be particularly objectionable when the passing stage is a well known three terminal Darlington transistor circuit, where the voltage variation with temperature due to the combined voltage drop of multiple transistors can cause voltage variations of typically 40 percent or more over the operating temperature range of the power supply. Moreover, in high current applications where several passing transistors are connected in parallel, the problems of current limiting each transistor to the safe value of its own prescribed current in case one or more passing transistors fail in an open or short circuit condition, can produce failures in the remaining transistors.

In the past a breakdown prevention diode has been used to remove excessive voltage from the input to an amplifier to prevent damage to the amplifier when the output voltage drop relative to the reference voltage becomes excessive, and is disclosed in, for example, U.S. Pat. No. 3,536,987 issued Oct. 27, 1970 to P. Muchnick. This circuit is used in a current mode and voltage mode power supply operating in the current mode where the voltage across the sense resistor controls the output current. However, in a voltage regulated power supply the purpose of the sensing resistor is generally for the protection of the power supply during an overload condition rather than for current control, and thus the smaller the resistance used as the sensing resistor, the greater the efficiency of the power supply. Those voltage regulated supplies which attempt to limit the value of the sensing resistor normally use the base-emitter drop of the series pass transistor in conjunction with the sensing resistor which, in turn, introduces a voltage, which is temperature dependent. In effect, the series pass transistor during warm up appears to indicate a change in current across the sensing resistor, thereby changing the selected current setting of the current limit circuit.

Accordingly, it is an object of the present invention to provide a novel circuit for protecting a transistorized, voltage regulated power supply from the aforementioned undesirable current limit variations and to provide improved current limiting and temperature tracking performance.

A further object of the present invention is to provide an improved circuit in which the current limit point can be accurately set to a fixed value when the power supply is either cold or hot, due to the improved stability of the current limit circuit.

Another object of the invention is to provide a power supply circuit of improved efficiency which protects against damage of transistors in a multiple series pass circuit due to a failure of one of the transistors.

A further object of the present invention is to provide an improved current limiting circuit for a voltage regulated power supply that is relatively simple in construction and operation, and yet highly efficient in use.

SUMMARY OF THE INVENTION

In accordance with the present invention, the foregoing objects and related advantages are attained in a simple circuit having an improved temperature stability of the current limiting setting and a reduction of power in the current sensing resistor in series with the passing stage by the addition of a normally conducting diode connected from the input end of the current sensing resistor to the current limit input of a well known voltage regulator circuit by way of a variable series resistor forming with a second resistor connected to one side of the power supply one leg of a voltage divider circuit adapted to develop a control voltage which sets the desired current limit level of the power supply during an overload.

The aforementioned diode is poled so that current flows from a source of reference voltage in the regulator circuit through another resistor, which can be variable, and through the diode to the input side of the current sensing resistor to maintain diode current. Adjustment of the resistor sets the short circuit or fold back current limit level of the power supply. The inclusion of the diode enables a lower voltage drop across the sampling or sensing resistor to develop a useable current limit control or error signal. In addition, the variable series resistor from the diode to the current limit input of the voltage regulator permits a controlled value of maximum current to be obtained. According to the invention, therefore, the anode to cathode drop of the diode offsets or cancels the base-emitter voltage of the current limit amplifier circuit thus making possible sensing of the actual voltage change in the voltage sensing resistor, which can then be relatively small. In this novel manner accurate current limiting and temperature tracking of the current limit amplifier is achieved by the diode with a smaller value of resistance in the current sensing resistor, thereby limiting the power dissipated in the current sensing resistor and increasing the efficiency of the power supply.

In its broader aspects, the regulated power supply of the invention contemplates a semiconductor device, such as for example, a diode having an anode to cathode drop which offsets or cancels the base-emitter voltage at the input of the associated semiconductor current limit amplifier circuit. A variable resistor is preferably connected in series with the diode to provide a simple setting for the power supply current limit circuit and a well known voltage source is used to maintain the diode in conduction.

In a further embodiment of the invention which has a voltage regulated output stage configuration utilizing two or more series pass transistors connected in parallel, there is provided individual diodes connected from the input end of one or more series sensing resistors to one common end of the series-connected limit level resistor which, in turn, is connected to the input of the current limit amplifier of the voltage regulator. In this arrangement, the individual diodes provide isolation so that the current limit level is determined by the transistor developing the highest voltage across its current sensing resistor. In normal operation the base-emitter drop of these parallel transistors and the drops across the current sensing resistors are usually sufficiently matched so that current sharing can occur in the added diodes. However, in the event that a passing transistor or a current sensing resistor fails in an open circuit condition, the remaining transistors are still protected from overload to essentially the same maximum previously adjusted current level because the current limiting signal cannot exceed the greatest level set for any individual passing transistor which is obtained through the individual diodes. When this set level is exceeded by any diode, the current limit circuit is actuated to limit the current through the passing transistors. The output power is still obtained up to the maximum current level set for the remaining transistors because any diode can activate the current limit circuit when the set level is exceeded.

BRIEF DESCRIPTION OF THE DRAWINGS

For a better understanding of the present invention, together with other and further objections thereof reference is made to the accompanying drawings in which.

DESCRIPTION OF THE PREFERRED EMBODIMENT

Figure 1:
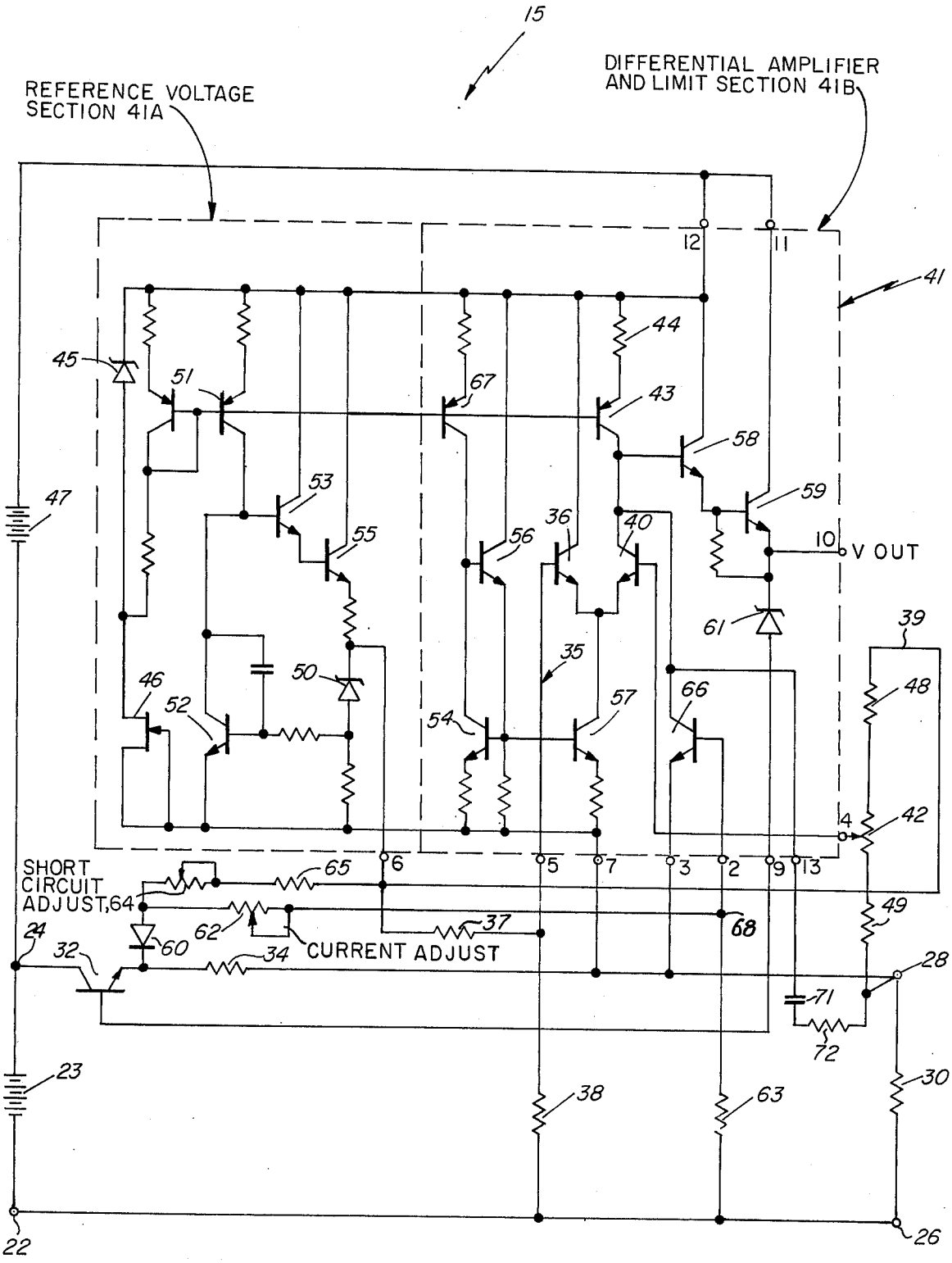
FIG. 1 is a schematic diagram of a voltage regulating circuit embodying features of the invention.

Referring now to FIG. 1 there is shown a voltage regulating circuit 15 having a negative input terminal 22 and a positive input terminal 24 adapted to receive a source of unregulated, unidirectional voltage, such as shown by source 23. The regulating circuit 15 is provided with a negative output terminal 26 and a positive output terminal 28 for supplying regulated output voltage to a load, represented as resistor 30. The negative input terminal 22 is connected to the negative output terminal 26.

A series pass transistor or series regulator 32 has its collector connected to the positive terminal 24 and its emitter connected through a series current sensing resistor 34 to the positive output terminal 28. The series transistor 32 may be considered a variable impedance which is controlled by a signal on its base electrode.

Means are provided to sample the amplitude of the voltage between terminals 26 and 28 and to feed the sample voltage back as an error or control signal to the base of transistor 32 to vary its impedance with the amplitude of the output voltage. To this end a voltage divider 35 is connected between the output terminal 26 and reference voltage lead 39 by way of divider resistors 37 and 38. Thus, a sample of the output voltage is sensed by transistor 36, the base input of which is connected to the junction of resistor 37 and resistor 38 in the voltage divider 35. The divider resistors 37 and 38 together with resistors 42, 48, and 49 assure that the output voltage $+E_o$, with respect to terminal 26 is of such a value that $+E_o$ plus the voltage $E_b$ at the base of transistor 40 is to $E_{ref}$ at lead 39 minus $E_b$ as the resistance of resistor 38 is to that of resistor 37. Thus, resistor 42 provides adjustment of the voltage $+E_0$.

It should be understood that the transistor 36 can form part of an integrated circuit 41, herein shown comprising a voltage reference section 41A and a differential current and limit section 41B. In the present instance, the circuit used is a Fairchild Linear Integrated Circuit No. $\mu$A723C which is commercially available and which is shown having external connecting pins or terminals 2 through 13. For convenience, the actual terminal numbers of this particular dual in-line integrated circuit are used. Also, the circuit within the connecting terminals is omitted, for convenience, from a subsequent embodiment and for the sake of pointing out with greater clarity the circuitry connected thereto to achieve the aforementioned features of the invention. Further, other well known reference and differential amplifier circuits can be used to provide reference and amplification functions.

The emitter of transistor 36 is connected to the emitter of transistor 40 in a well known differential amplifier circuit. The collector of transistor 36 is connected directly to terminal 12 to which is applied the main source of positive reference voltage 47.

The impedance of the collector of differential amplifier transistor 40 is provided by integrated circuit transistor 43 and resistor 44 which provide a high impedance load to the collector of transistor 40. This is achieved by well known integrated circuit techniques which maintain the required bias on the base of transistor 43 by Zener reference diode 45 in conjunction with constant current semiconductor device 46 in reference voltage section 41A of integrated circuit 41.

Further referring to reference section 41A, the reference voltage applied to lead 39 is derived at Zener reference diode 50 by way of pin 6. In particular, reference section transistor 52 with current source 51 provides a current feedback source into Darlington circuit transistor elements 53 and 55 to maintain in a known manner Zener diode 50 at a constant voltage regardless of the load developed on lead 39. In the present instance, transistor 52 in connection with Zener diode 50 maintains a control voltage of, for example, 0.7 volts to provide in a known manner a basic or fixed reference voltage at pin 6 or lead 39 of approximately 7.15 volts. A portion of this voltage is applied by voltage divider action to pin 5 and the base of transistor 36.

In the differential amplifier and limit section 41B, the emitter of transistors 36 and 40 are returned to pin 7 by way of common emitter bias transistor 57 and its associated resistor, which supplies bias current for the differential amplifier transistors 36 and 40. The emitter of transistor 57 is returned to the reference common at pin 7 of the integrated circuit which, in turn, is connected to terminal 28. Bias is supplied in transistor 57 by transistors 54, 56 and 67 in a voltage source arrangement. The output or collector of differential amplifier transistor 40 is fed to transistors 58 and 59 connected as a Darlington amplifier for the purpose of increasing current gain from the output of transistor 40 to the emitter of transistor 59. Zener diode 61 is used to offset the output voltage on the emitter of transistor 59 by approximately 6.2 volts for the convenience of shifting the voltage level at terminal 9 so as to drive the base of series pass transistor 32 at a compatible voltage level approximately one volt above the voltage appearing on pin 7 at the output of sensing resistor 34 for the operation of series pass transistor 32. Thus, the voltage on the collector of transistor 40 is the amplified difference between the base of transistor 36 and the base of transistor 40. When one input to the base of the transistor 36 changes with respect to that at the base of transistor 40 due to a change in load 30 or power supply input voltage, the amplified difference is applied to pin 9 and the base of series pass transistor 32 to correct the error.

In order to adjust the particular desired voltage output level of the power supply, the base of transistor 40 is connected by way of pin 4 to a voltage adjust potentiometer 42 which in conjunction with series connected resistors 48 and 49 form in a known manner a voltage divider across the reference voltage available at lead 39 and terminal 28.

Connected to the collector of transistor 40 is a well known stability compensation network extending from pin 13 to terminal 28 and comprising capacitor 71 in series with resistor 72.

Connected also to the collector of differential amplifier transistor 40 is an input or amplifying transistor 66 having its emitter connected by way of the current sense input pin 3 of the integrated circuit to the output side of sensing resistor 34. The base of input transistor 66 is connected by way of the current limit pin 2 of the integrated circuit to resistor 63 which in turn is connected to the negative terminal 26 of the power supply. Resistor 63 forms the lower leg of a voltage divider and applies a current limit voltage to the base of transistor 66 in a manner to be described. The junction of pin 2 at the base of transistor 66 is also connected by way of a current adjust potentiometer 62, short circuit adjust potentiometer 64, lower limit resistor 65 to the source of basic reference voltage supplied by Zener diode 50 at pin 6 of the integrated circuit. These potentiometers 64 and 65 are adjusted in connection with a novel voltage subtracting diode 60 which is connected from the input to the current sensing resistor 34 to the base of amplifier input or current limit transistor 66 by way of current adjust potentiometer 62. Diode 60 is poled in a direction to provide a voltage drop which subtracts or offsets in a novel manner the base-emitter drop of input transistor 66 which permits accurate measurement or sensing by transistor 66 of the current through sensing resistor 34 without degradation of the desired current limit setting.

In operation, transistor 66 is normally nonconducting due to the base of the transistor being less positive than approximately 0.7 volts with respect to the emitter voltage on pin 3 which is connected to the output of the sense resistor. Thus, under these conditions transistor 66 is not operating and cut off. However, when the power supply output current increases during an overload to the point at which the voltage across current sense resistor 34 causes the voltage at the base of transistor 66 to increase to the point, above 0.7 volts relative to pin 3, for example, transistor 66 conducts. This conduction diverts current from the collector of transistor 40 to transistor 66 instead of to transistor 58, and the voltage at the collector of transistor 40 tends to fall to reduce the voltage applied to the base of series pass transistor 32 by way of Zener diode 61 and transistors 58 and 59. The output voltage at terminals 28 and 26 decreases and the circuit is now in the current limiting condition and the current limit or drive voltage between the base and emitter, pin 2 and pin 3, respectively, of transistor 66 is proportional to the voltage developed across sense resistor 34. By addition of the diode 60, in accordance with the invention, the voltage at the input to sense resistor 34 is shifted by approximately 0.7 volts due to the current provided by the voltage reference at pin 6 flowing through potentiometer 64 and the load resistor 30. Thus, the diode 60 has, for example, a 0.7 volt drop to conduct, which voltage drop corresponds to the voltage drop required between the base and emitter of transistor 66 to initiate conduction therein. The diode 60 thus subtracts the base-emitter drop of transistor 66 and permits accurate sensing of the current across sense resistor 34.

To achieve this advantage, the voltage divider junction 68 or resistor 63 and potentiometer 62 feeds a voltage to pin 2 sufficient to permit the voltage across sense resistor 34 to increase to a prescribed level. This is achieved by setting current adjust potentiometer 62 to a level where transistor 66 begins to conduct thereby permitting; for example, the 0.7 volts to start from substantially zero voltage across sense resistor 34, corresponding to zero current, up to a value determined by the ratio of the resistance of potentiometer divider resistor 62 to divider resistor 63. Thus, the power supply can operate from approximately zero current upward. The invention therefore takes advantage of the approximate 0.7 volts developed across diode 60 to offset the base-emitter input voltage of transistor 66 and to provide a control voltage at the base of series pass transistor 32. At the same time, the voltage variation with temperature across diode 60 tends to compensate for the change due to temperature at the base and emitter of amplifier input transistor 66. Thus, accurate temperature tracking is achieved with a relatively small voltage being required, thus limiting dissipation in sense resistor 34 and increasing the efficiency of the regulated power supply.

The invention further discloses the addition of the short circuit adjust resistor, which is shown herein as potentiometer resistor 64 connected from diode 60 by way of a current limit resistor 65 to the basic or fixed reference voltage source of approximately 7.15 volts at pin 6. Resistor 65 sets the lower limit or foldback of the circuit under a short circuit condition.

To set the desired point at which current limiting of the power supply commences, potentiometer 62 is preferably adjusted by applying a load of approximately 120 to 140 percent above the normal selected operating load represented by load resistor 30 with the potentiometer 62 set to obtain maximum output voltage which corresponds to a maximum resistance in potentiometer 62. At this point current limiting is essentially inoperative. Then the potentiometer 62 is adjusted or backed off until the voltage at output terminals 26 and 28 begins to fall by a small percentage meaning that the current limiting action of transistor 66, transistor 58 and its associated circuits has commenced, thus permitting accurate limiting to be obtained over a wide range of operating values with a relatively small sensing resistor 34, the sensing voltage being fed to transistor 66.

To set the short circuit potentiometer 64, a short circuit is first applied across load resistor 30 and the output or foldback current under these conditions is adjusted by setting potentiometer 64 so that series pass transistor 32 limits the output current to a desired value of, for example, one-half the rated full load current for the power supply. The short is then removed from across load resistor 30 and the power supply returns to normal load operation.

Figure 2:
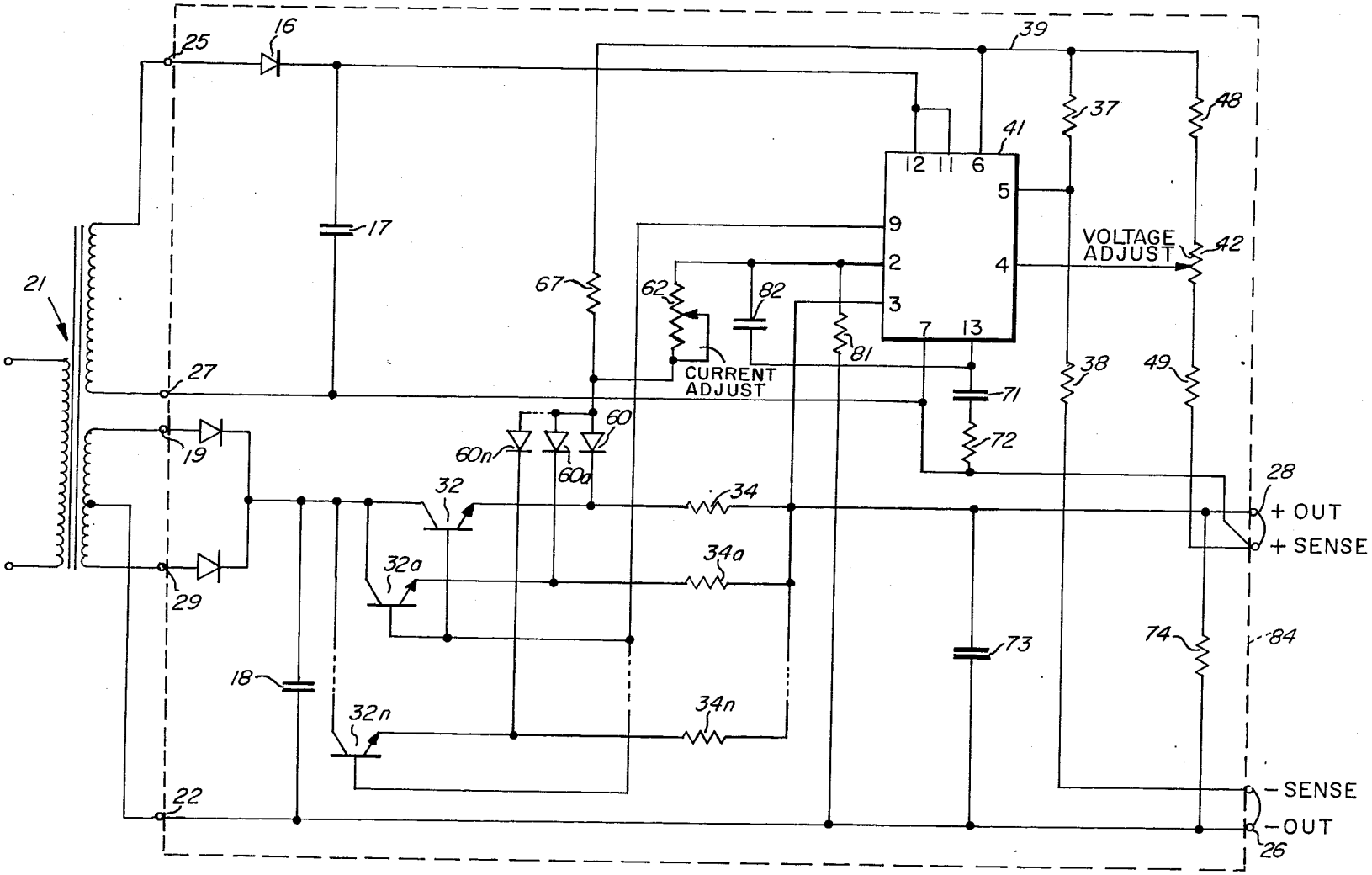
FIG. 2 is a schematic diagram of another embodiment of the invention employing additional passing transistors connected in parallel with added details.

Referring now to FIG. 2 there is shown a detailed schematic circuit of a regulated power supply having similar functions and components as the circuit shown in FIG. 1 except that two or more series pass transistors are connected in parallel, each having its individual diode connected from the input end of each pair of parallel connected series sensing resistors to the common end of a series-connected limit level resistor which, in turn, is connected to the input of the current limit amplifier which forms a part of an integrated circuit 41 in the manner shown in FIG. 1. Corresponding parts in FIGS. 1 and 2 bear the same numbers. In this embodiment an input transformer 21 has alternating current applied to its primary winding and a secondary winding connected by way of terminals 25 and 27 to rectifier 16 and to filter capacitor 17 to provide a reference source for the integrated circuit 41 by way of pins 7, 11 and 12. In like manner, the transformer also supplies a full wave rectified output by well known diodes connected to another secondary winding at terminals 19, 22, and 29. These terminals with terminals 25 and 27 make possible the connection of transformers having different current ratings depending upon the number of series pass transistors used in a parallel circuit to achieve the desired current handling capacity.

Capacitor 18 is a filter capacitor for the full wave rectified source of alternating current applied to the primary of transformer 21. The source of direct current across capacitor 18 is applied to the parallel input of series pass transistors 32 and 32*a* in series, respectively, with sensing resistors 34 and 34*a*. In the event that a passing transistor or its sensing resistor fails in an open circuit condition, the individual diodes 60 and 60*a* isolate and maintain approximately the same current level in its associated transistor by providing an individual current limiting signal through each diode. These signals are applied by way of the current adjust potentiometer 62 to pin 2 of the integrated circuit amplifier stage while the common output of parallel sensing resistors 34 and 34*a* are connected to pin 3. The individual voltage drop of the diode which in conjunction with the sensing resistor developes the greatest voltage, is the diode that controls the actual current limit point and is used to offset the base-emitter drop between pin 2 and pin 3. Since each diode and its sense resistor are preferably selected to be of the same type and value, there is a tendency for the diodes to share the current by way of current limit resistor 67. In the event of failure of one of the associated series pass transistors or its corresponding sense resistor, one of the remaining operative diodes maintains substantially the same value of current limit in each of the remaining series pass transistors. This is due to the OR circuit action of the diode combination. In the event of a short circuit in one of the passing transistors the sense resistor is selected to be a fusible type so that the same operation ensues.

Resistor 67 corresponds to short circuit limit or adjust potentiometer 64 described in FIG. 1 except that it is shown fixed to a predetermined value of current limit or foldback. It provides, during a short circuit condition, a portion of the internal reference voltage available at pin 6 to add to the voltage applied to pin 2 by way of current adjust potentiometer 62 to offset the loss developed by resistor 81 during the short circuit condition. Capacitor 82 preferably is connected from pin 2 to pin 13 for the purpose of providing output stability during current limiting.

Current adjust potentiometer 62 is set as described with reference to FIG. 1. At this setting, during overload, variation of the setting with temperature such as during warm up of the input amplifier, is compensated for by the cancellation voltage developed across the anode to cathode of the controlling parallel connected diode which developes the greatest voltage between pins 2 and 3. This permits accurate current limiting by the sensing resistors 34 and 34*a* in their respective diode circuits.

When it is desirable to provide a heavy output current, transformer 21 can be exchanged for a transformer of increased power capacity by connection to terminals 22, 25, 27, 19 and 29. The primary of transformer 21 and the transformer of increased capacity can be connected to same source of alternating current. Also, additional series pass transistors can be added to the circuit, such as for example transistor 32*n*, along with a corresponding additional diode 60*n* and sensing resistor 34*n* adapted to regulate the additional current supplied by the power transformer which can be mounted outside and plugged into self-contained unit 84 for better heat dissipation. It is also noted that output terminals 28 and 26 include terminal means for remote sensing of the output voltage in a well known manner by removal of the jumper shown connected to each output terminal. In this method of operation, the voltage adjust potentiometer 42 is also set to achieve the desired output voltage and the aforementioned current limiting and temperature tracking advantages of the novel diode and its associated circuitry are achieved.

From the above description it will be evident that a voltage subtracting diode circuit has been described which can be used in connection with the input current limit and reference amplifier circuit in a regulated power supply. This arrangement enables compensation and bucking out of the base-emitter or input voltage during warm up of the current limit amplifying transistor which permits lowering of the effective value of the sense resistor required to provide a limit control voltage and thus provides accurate regulation with a smaller and more efficient sensing resistor in the series pass circuit.

The foregoing disclosure and drawings are merely illustrative of the principles of the invention are not be interpreted in a limiting sense. Accordingly, the only limitations will be determined by the scope of the appended claims.

What is claimed is:

1. A voltage regulated power supply comprising a pair of load terminals for connecting a load to be supplied with regulated voltage, a series pass transistor connected to an input terminal of said power supply, a transistor regulator circuit, the control electrode of said series pass transistor being fed by the output of said regulator circuit, said regulator circuit including a differential voltage amplifier and a transistor current limit amplifier, said transistor current limit amplifier coupled to said differential voltage amplifier, a series sensing impedance connected in series with said series pass transistor and a load terminal, another input terminal connected to the other load terminal, means for applying voltage developed across said series sensing impedance to an input of said transistor current limit amplifier, said means including a diode and a first resistor of predetermined value connected from the current sensing input of said transistor current limit amplifier to the input side of said series sensing impedance and cooperating with a second resistor to form a voltage divider, the junction of which is connected to the input of said transistor current limit amplifier in a manner so that prior to and during current overload of said power supply, diode conduction voltage subtracts a voltage corresponding to a predetermined portion of the base-emitter voltage drop at the input of said transistor current limit amplifier to permit less resistance in said series sensing impedance to develop during said current overload an effective value of voltage at the input of said transistor current limit amplifier, whereby said differential voltage amplifier provides an output for said transistor regulator circuit.

2. A voltage regulated power supply as set forth in claim 1 in which said transistor regulator circuit includes a regulated reference voltage source adapted to maintain said diode conductive.

3. A regulated power supply comprising a regulating device connected in series with the input circuit of the power supply, a transistor amplifier circuit adapted to produce current limit signals and having a predetermined voltage drop between base and emitter of its input transistor, means for coupling said current limit signals to increase the impedance of said regulating device, a series sense impedance connected in series with the regulating device and output circuits of said power supply, a diode having a predetermined voltage drop including resistance means adapted to buck out a predetermined value of voltage required for conduction across the base-emitter of the input transistor, said diode connected between the input of said transistor amplifier circuit and the input side of said series impedance and poled in a direction to provide a value of current limit voltage from said series sense impedance to the input of said transistor amplifier circuit to produce said current limit signals during current overload of said power supply.

4. A voltage regulated power supply comprising a regulator circuit which includes series regulating means, a pair of load terminals for connecting a load circuit to be supplied with regulated voltage, a sensing resistance coupled to said load circuit, a transistor current limit amplifier having an inherent voltage drop between the base-emitter input terminals coupled between the sensing resistance and a control input of said series regulating means to provide a current limit signal to said series regulating means during a current overload of said regulated power supply, said series regulating means connected to an input terminal of said power supply, said current sensing resistance connected in series with said series regulating means and said load circuit, and a diode having a predetermined voltage drop including resistance means connected in a manner to buck out a predetermined portion of the voltage required for conduction at the base-emitter terminals of said transistor current limit amplifier to reduce the effective value of said current sensing resistance required to provide a current limit signal capable of reducing the output of said power supply at said load terminals, said diode connected from the input side of said current sensing resistance to an input of said transistor current limit amplifier.

5. A voltage regulated power supply as set forth in claim 4 wherein said series regulating means is a plurality of transistors each connected to a corresponding sensing resistance coupled to said load circuit and each having a corresponding diode coupled between each sensing resistance and the base-emitter input of said transistor current limit amplifier.

6. A voltage regulated power supply as set forth in claim 4 wherein said transistor current limit amplifier is coupled to the junction of a pair of serially connected voltage divider resistors connected between a load terminal and the electrode of said diode connected to the input side of said transistor current limit amplifier, thereby to set a level at which said transistor current limit amplifier commences to conduct.

7. A voltage regulated power supply comprising a power source to be voltage regulated, a pair of load terminals for connecting a load to be supplied with regulated voltage, a differential amplifier including a plurality of transistors and a current limit transistor coupled to said plurality of transistors, each having base, emitter and collector electrodes, a series pass transistor connected to an input terminal of said power supply, the other input terminal connected to one of said load terminals, a control electrode of said series pass transistor adapted to be fed by a current limit control signal from said current limit transistor during an overload condition of said power supply, a sensing impedance device connected in series with said series pass transistor and the other load terminal, and a diode having a predetermined voltage drop connected between the input side of said sensing impedance device and to one input electrode of said current limit transistor, means for connecting the output side of said sensing impedance device to the other input electrode of said current limit transistor, said diode including adjustable resistance means adapted to buck out a predetermined value of the base-emitter voltage of said current limit transistor in a direction to track the base-emitter voltage change with temperature in said current limit transistor.

8. A voltage regulated power supply as set forth in claim 7 which includes a basic reference voltage source and a predetermined resistance in series with said basic reference voltage source connected to an input electrode of said current limit transistor to set the value of said current during a short circuit overload, thereby to provide adjustable current limit means for variation of the short circuit current limit level in said current limit transistor.

9. A regulated power supply comprising a regulating device connected in series with the input circuit of the power supply, an amplifier circuit operative to produce error signals representative of variations in output voltage, said amplifier circuit having a current limit transistor coupled thereto and adapted to conduct during a current overload, means for coupling said error signals to vary the impedance of said regulating device, a series sense impedance connected in series with the regulating device and output circuits of said power supply, a semiconductor device having a predetermined voltage drop and serially connected resistance means of a value adapted to buck out a predetermined portion of the voltage developed at the input terminals of said current limit transistor, said semiconductor device connected to said serially connected resistance means between an input terminal of said current limit transistor and the input side of said series sense impedance to permit a lower effective value of said series sense impedance to provide a current limit control voltage, means for coupling error output signals representative of variations in current through said series sense impedance during said current overload of said regulating power supply to vary the conductivity of said regulating device, a reference voltage supply, a variable resistance connected in series with said reference voltage supply and said semiconductor device to maintain a predetermined level of short circuit current in said semiconductor device, said variable resistance connected to a current resistor and a serial-connected second resistor connected to one side of said power supply to form a voltage divider, the junction of said current adjust resistor and said second resistor being connected to the input side of said current limit transistor to maintain during a predetermined overload a predetermined level of output current, said reference voltage supply connected by way of said variable resistor to the junction of said semiconductor device and one end of said current adjust resistor whereby the voltage drop of said semiconductor device is adapted to be subtracted from the voltage drop developed at the input of said current limiting transistor while maintaining a predetermined current flow from said reference voltage supply through said current adjust resistor for adjusting the value of the voltage applied between the base and emitter of said input transistor.

10. A voltage regulated power supply comprising a series pass semiconductor device connected in series with the input circuits of the power supply, an amplifier circuit having a current limit transistor, a series sense resistance connected in series with the series pass semiconductor device and the output circuits of said power supply, means for coupling from said amplifier circuit error signals representative of variations in current through said series resistance to vary the conductivity of said series pass semiconductor device, said current limit transistor having an input circuit, a current adjust resistance for setting a current limit point connected to one terminal of said input circuit, a diode connected in series with said current adjust resistance and the input side of said series sense resistance, the other terminal of said input circuit of said current limit transistor connected to the output side of said series sensing impedance, whereby the electrodes at the input of said current limit transistor are effectively connected in series with said series sense resistance, said diode and said current adjust resistance, said diode poled in a direction to coact with the value of overload current set by a predetermined value of said current adjust resistance so that the voltage drop of said diode cancels out a predetermined value of the voltage drop developed across the input terminals of said current limit semiconductor, and a source of reference voltage connected by way of a short circuit adjust potentiometer to the junction of said diode and said current adjust resistance to maintain said diode in conduction.

11. A voltage regulated power supply comprising a regulating device in series with the input circuit of the power supply, an amplifier circuit, said amplifier circuit having a current limit semiconductor device coupled thereto, a series sense impedance connected in series with the regulating device and output circuits of said power supply, a semiconductor device connected in series with a resistance set to a value to provide a predetermined voltage drop adapted to buck out voltage developed at the input of said current limit semiconductor device, said semiconductor device and said resistance connected between an input of said current limit semiconductor device and the input side of said series sense impedance and poled in a direction to provide during current overload of said power supply a current limit control voltage, said amplifier circuit coacting with said current limit control voltage to provide error signals representative of variations in current through said series sense impedance during said current overload of said regulated power supply to vary the conductivity of said regulating device.

12. A voltage regulated power supply as set forth in claim 11 in which said amplifier circuit is connected to means for adjusting the percentage of overload current reguired to actuate said current limit semiconductor device to initiate said error signals.

13. A regulated power supply comprising a semiconductor regulating device in series with the input circuit of said power supply, a transistor amplifier circuit having a semiconductor amplifier device coupled thereto, a series sense impedance connected in series with the semiconductor regulating device and output circuits of said power supply, a unidirectional semiconductor having a predetermined voltage drop adapted to buck out a predetermined value of the voltage drop developed across the input of said semiconductor amplifier device, said unidirectional semiconductor device being connected in series with a predetermined resistance divider between an input of said semiconductor amplifier device and the input side of said series sense impedance to lower the effective value of said series sense impedance required to provide a current limit error voltage to the input of said semiconductor amplifier device, and means during overload of said power supply coacting with said transistor amplifier circuit and said semiconductor amplifier device to couple to said semiconductor regulating device error signals representative of variations in current through said series sense impedance during said current overload of said power supply.

14. A regulated power supply comprising a plurality of series pass transistors having an input electrode in series with an input terminal of the power supply and an output electrode each in series with a corresponding series sense impedance, the output of each series sense impedance being coupled to a common output terminal of said power supply, a semiconductor amplifier having a current limit transistor coupled thereto, a current adjust resistance, a diode connected from the input side of each series sense impedance to a common side of said current adjust resistance, the other side of said current adjust resistance coupled to one input terminal of said current limit transistor, the outer input terminal coupled to the output side of each of said series sense impedances, each of said diodes poled in a direction to buck out voltage developed at the input of said current limit transistor to maintain an effective value of current required to provide a current limit voltage during current overload of said power supply, means for coupling during said current overload error signals from the output of said semiconductor amplifier to the control electrode of each of said series pass transistors, thereby to limit power supply current to a predetermined value, said current adjust resistance having a predetermined value which is adjusted to provide the maximum overload current through any one of said series pass transistors during activation of said current limit transistor.

15. A regulated power supply comprising a regulating device connected in series with the input circuits of the power supply, a transistor amplifier circuit operative to produce error signals representative of variations in output potential, the input to said transistor amplifier having an inherent voltage drop across the input electrodes of an input transistor, means for coupling said error signals to vary the impedance of said regulating device, a series sense impedance connected in series with the regulating device and output circuits of said power supply, a unidirectional semiconductor device and a current adjust resistance connected in a direction in which a predetermined voltage drop developed across its electrodes cancels out a predetermined value of the inherent voltage drop across the input electrodes of said input transistor so that during a current overload of said power supply a substantially smaller value of said series sense impedance is required to provide a level of voltage to said input terminals of said transistor amplifier circuit to produce error signals, said unidirectional semiconductor device connected by way of said current adjust resistance between an input terminal of said transistor amplifier and the input side of said series impedance and adapted to provide said predetermined value of the inherent voltage drop, and a voltage reference source connected by way of a predetermined value of resistance to the input terminal side of said unidirectional semiconductor device to maintain said latter device conductive and to provide a predetermined current level during overload of said power supply.

16. A regulated power supply as set forth in claim 15 in which current adjust resistance maintains said predetermined voltage drop at a value of base-emitter voltage a few percent below the value required for conduction of said input transistor at the desired operating load level for said power supply.

17. A regulated power supply as set forth in claim 15 in which said regulating device comprises a plurality of series pass transistors each having a corresponding series sense impedance connected in series with its series pass transistor and the output circuits of said power supply, a unidirectional semiconductor device connected from the input side of each series sense impedance to a common connection on said current adjust resistance to provide an OR circuit wherein during an overload failure of a transistor or its corresponding series sense impedance the unidirectional semiconductor device which develops in conjunction with its series sense impedance the greatest voltage at said common connection provides said error signals to vary the impedance of said regulating device.

* * * * *

UNITED STATES PATENT OFFICE

CERTIFICATE OF CORRECTION

Patent No. 4,025,841 Dated May 24, 1977

Inventor(s) Derek Chambers and Robert O. Pedersen

It is certified that error appears in the above-identified patent and that said Letters Patent are hereby corrected as shown below:

Column 3, line 46: after "positive" insert -- input --;
Column 6, line 30: after "small" insert -- sensing --;
Column 11, line 4: after "current" insert -- adjust --;
Column 12, line 46: change "outer" to -- other --; and
Column 14, line 4: after "which" insert -- said --.

Signed and Sealed this

*Thirteenth* Day of *September 1977*

[SEAL]

*Attest:*

RUTH C. MASON
*Attesting Officer*

LUTRELLE F. PARKER
*Acting Commissioner of Patents and Trademarks*